US005500722A

United States Patent [19]

Jacobs

[11] Patent Number: 5,500,722

[45] Date of Patent: Mar. 19, 1996

[54] WEB WITH TUBE OIL APPLICATOR

[75] Inventor: Robert M. Jacobs, Ontario, N.Y.

[73] Assignee: Xerox Corporation, Stamford, Conn.

[21] Appl. No.: 923,651

[22] Filed: Aug. 3, 1992

[51] Int. Cl.[6] ..... G03G 15/20

[52] U.S. Cl. ..... 355/284; 219/216; 355/282

[58] Field of Search ..... 355/282, 285, 355/284, 289, 290, 295, 300; 219/216

[56] References Cited

U.S. PATENT DOCUMENTS 4,393,804 7/1983 Nygard et al. ..... 118/60
4,949,096 8/1990 Ogawa et al. ..... 355/285 X
5,049,943 9/1991 Menjo et al. ..... 355/284
5,049,944 9/1991 DeBolt et al. ..... 355/284

*Primary Examiner*—Matthew S. Smith
*Assistant Examiner*—T. A. Dang

[57] ABSTRACT

Release Agent Management system for a heat and pressure fuser for fixing black toner images in low and high volume imaging machines and also for fixing color images. An auxiliary oil supply is provided for applying extra oil to an oil impregnated web. The extra oil improves fuser roll release life in every application. Also, enables color fusing which requires higher oil application rates.

8 Claims, 3 Drawing Sheets

WEB WITH TUBE OIL APPLICATOR

BACKGROUND OF THE INVENTION

The present invention relates to fuser apparatus for electrostatographic printing machines and in particular to a roll fuser release agent management (RAM) system.

In the process of xerography, a light image of an original to be reproduced is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset." Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene, known by the tradename Teflon to which a release agent such as silicone oil is applied, the thickness of the Teflon being on the order of several mils and the thickness of the oil being less than 1 micron. Silicone based (polydimethylsiloxane) oils which possesses a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of adhesive material to a rigid core or substrate such as the solid Teflon outer surface or covering of the aforementioned arrangement.

Various systems have been used to deliver release agent fluid to the fuser roll including ones that use oil soaked rolls and wicks with and without supply sumps as well as oil impregnated webs. The oil soaked rolls and wicks generally suffer from the difficulty in that they require a sump of oil to replenish the roll and the wick as its supply of release agent is depleted by transfer to the fuser roll. Furthermore, a wick suffers from the difficulty of a relatively short life, around 10,000 prints. Furthermore, these systems suffer from the further difficulty, in that, their surfaces in contact with the fuser roll are constant whereby contamination particularly by toner and paper can readily occur further reducing valuable life. The web systems, on the other hand are limited in the quantity of oil they can deliver.

U.S. Pat. No. 3,941,558 to Takiguchi discloses a rolled web impregnated with silicone oil for preventing offset. The web has a thickness of 2 mm, a total length of 50 cm, and travels one cm per thousand copies between the supply and take-up rollers. This system transfers about 0.003 cc of oil to the fuser per copy.

U.S. Pat. No. 4,393,804 to Nygard et al. discloses a rolled web system that moves between a supply core and take-up roller. A felt applicator supplies oil from a supply reservoir to the web. The take-up core is driven by a slip clutch at a speed greater than the speed of the pressure roller, thus exerting tension on the web. The web is between one and two mm in thickness and moves at a constant speed of five cm per 200 to 1,000 copies.

U.S. Pat. No. 5,049,944 granted to DeBolt et al on Sep. 17, 1991 relates to apparatus for applying offset preventing liquid to a fuser roll including: a supply core; a rotatable take up core; an oil impregnated web member adapted to be moved from the supply core to the take-up core; a motor mechanically coupled to the take up roll for driving the web member from the supply core to the take up core; a pressure roll in engagement with the web member and positioned to provide a contact nip for the web member with the fuser roll opposite the pressure roll wherein the contact of the web member with the fuser roll transfers oil from the web member to the fuser roll and control means to vary the duty cycle operation of the motor to drive the web member at a relatively constant linear speed at the contact nip. In addition to the oil impregnated web, a foam pinch roll is also impregnated with release agent material to insure that any sections of the web that may have been loaded with an inadequate quantity of silicone oil are supplied with additional release agent material.

In addition, there are several automatic printing machines commercially available. For example, the Canon 3225, 3725, 3000 series, 4000 series and 5000 series products all have liquid release agent impregnated webs supported between a supply roll and a take-up roll and urged into contact with the fuser roll by an open celled foam pinch roll. Additionally, the Xerox™ 5028™ machine utilizes an oil impregnated web for application of between 0.1 to 0.5 micro liters per copy of release agent material to a heated fuser roll.

Although RAM systems utilizing oil impregnated webs provide an adequate quantity of release agent material for low copy volumes they are not suitable for high volume machines such as printers or for use in machines that produce color copies or prints. Also, roll fusers used for fixing color images require a greater quantity of oil application than oil impregnated webs are capable of delivering. The release properties of fuser rolls operated with insufficient release material degrade to an unacceptable level.

SUMMARY OF THE INVENTION

Briefly, the present invention comprises a RAM system in the form of an oil impregnated web and an auxiliary oil supply therefor. The RAM system comprises a supply member, a rotatable take-up member, an oil impregnated web member adapted to be moved from the supply core to the take-up core, a motor mechanically coupled to the take up roll for driving the web member from the supply core to the take-up core, a pressure roll for effecting pressure contact of the oil impregnated web member and a heated fuser roll member. A auxiliary supply of liquid release agent is provided for applying an additional quantity of release agent fluid to the oil impregnated web for high volume operation as well as for fusing color images. The concept is also be used to increase the fuser roll life of a low volume machine.

For a better understanding of the present invention, reference may be had to the accompanying drawings wherein the same reference numerals have been applied to like parts and wherein:

DESCRIPTION OF THE PREFERRED EMBODIMENT

Figure 3:
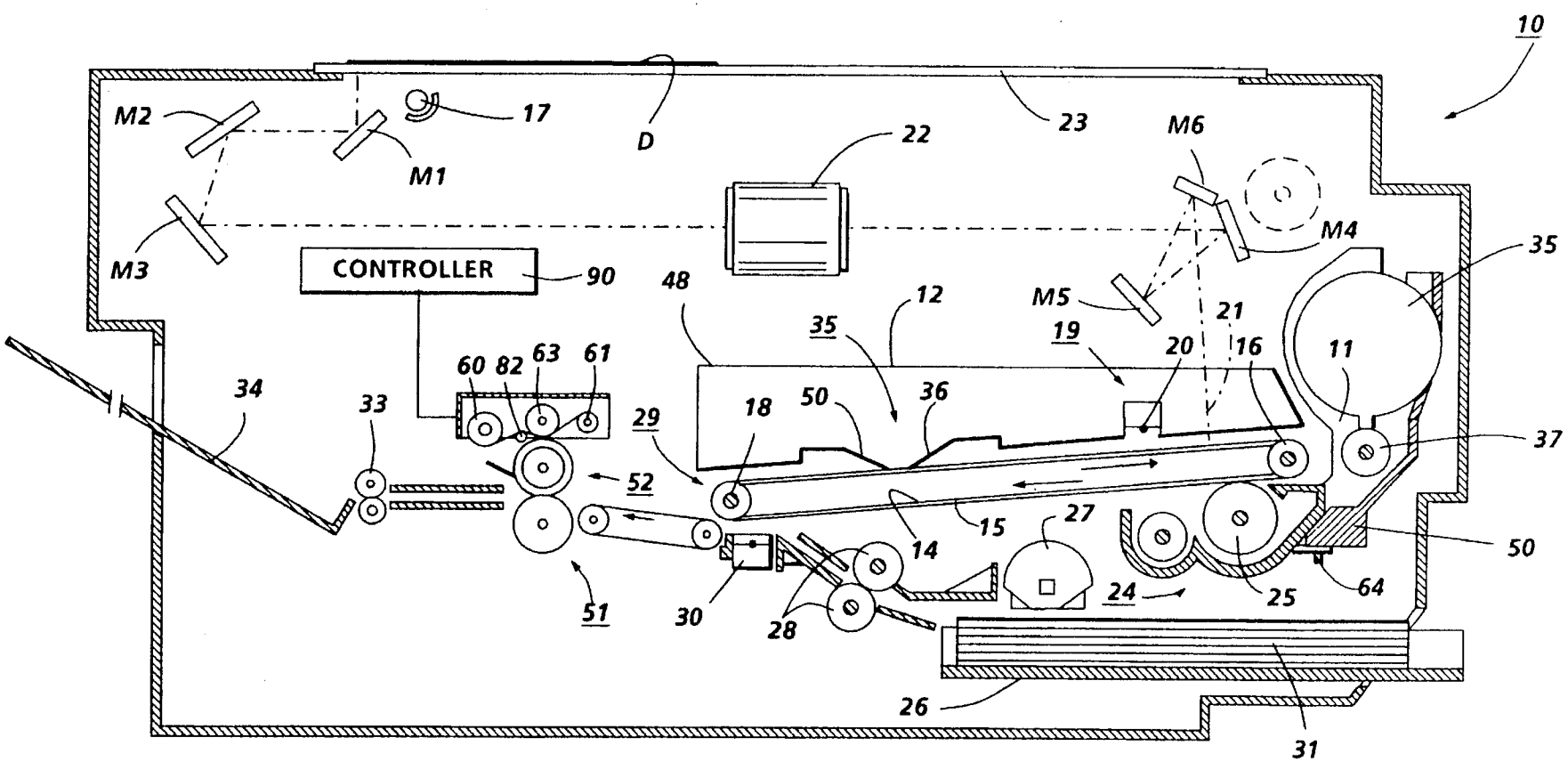
FIG. 3 is a schematic representation in cross-section of an automatic electrostatographic printing machine with a fuser apparatus incorporating the present invention.

Referring now to FIG. 3, there is shown by way of example, an automatic electrostatographic reproducing machine 10 which includes a RAM system according to the present invention. The reproducing machine depicted in FIG. 3 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including electrostatographic printing systems and is not necessarily limited in application to the particular embodiment or embodiment shown herein.

The reproducing machine 10 illustrated in FIG. 3 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for movement within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown) to scan the original document D on the imaging platen 23, lens 22 and mirrors $M_4$, $M_5$, $M_6$ to transmit the image to the photoconductive belt in a well known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetic developer mix having course magnetic carrier granules and toner colorant particles.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 52 fixes the transferred powder image thereto. After fusing the toner image to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

Figure 1:
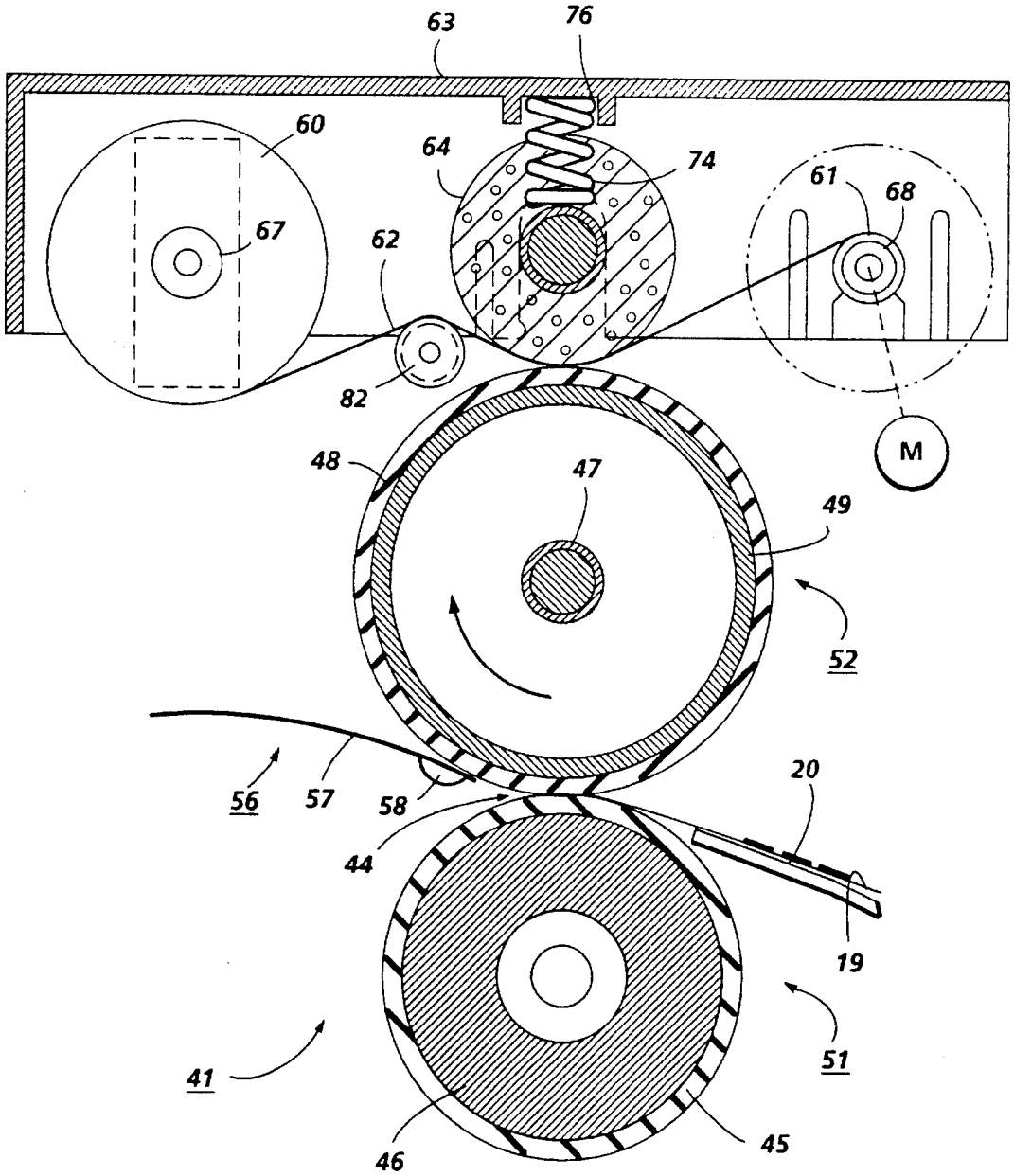
FIG. 1 is an enlarged view in cross-section of a fuser apparatus incorporated in the printing machine of 1.

Attention is now directed to FIG. 1 wherein the fuser apparatus is described in greater detail. As shown in FIG. 1, the fuser roll 52 is composed of a core 49 having coated thereon a thin layer 48 of an elastomer. The core 49 may be made of various metals such as iron, aluminum, nickel, stainless steel, etc., and various synthetic resins. Aluminum is preferred as the material for the core 49, although this is not critical. The core 49 is hollow and a heating element 47 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. All heating means are well known in the art for providing sufficient heat to fuse the toner to the support. The thin fusing elastomer layer may be made of any of the well known materials such as the RTV and HTV silicone elastomers.

The fuser roll 52 is shown in a pressure contact arrangement with a backup or pressure roll 51. The pressure roll 51 comprises a metal core 46 with a layer 45 of a heat-resistant material. In this assembly, both the fuser roll 52 and the pressure roll 51 are mounted on bearings (not shown) which are mechanically biased so that the fuser roll 52 and pressure roll 51 are pressed against each other under sufficient pressure to form a nip in area 44. It is in this nip that the fusing or fixing action takes place. The layer 45 may be made of any of the well known materials such as fluorinated ethylene propylene copolymer or silicone rubber.

The liquid release agent delivery system or RAM (release agent management) system comprises a housing 63 which may typically be a one-piece plastic molded member having mounting elements such as slots or holes for an oil impregnated web, supply roll 60, a web take-up roll 61 and an open celled foam pinch roll 64. The web supply roll 60 and web take-up roll 61 are supported in the housing such that when a liquid release agent delivery system is in place, one of the supply roll 60 and take-up rolls 61 is on one side of the fuser roll 52 and the other is on the other side of the fuser roll and the movable web 62 is in contact with the fuser roll 52 along a path parallel to its longitudinal axis. In addition, the movable web 62 is urged into delivery engagement with the fuser roll by the open celled foam pinch roll 64 positioned on the side of the web 62 opposite the fuser roll 52.

The supply roll 60 and take-up roll 61 are each made from interchangeable rotatable tubular support cores 67 and 68 to enable the reversibility of the web. The supply roll core 67 has a supply of release agent impregnated web material 62 wound around the core and is tensioned within the housing to resist unwinding by means of a leaf spring, not shown, at each end of the housing 63 which urges mounting collars, also not shown, into engagement with the rotatable tubular support core 67. The foam pinch roll 64 is spring biased toward the fuser roll by two coil springs 74 (only one shown), one at each end of the pinch roll mounting slot 76 to apply pressure between the web 62 and the fuser roll 52 to insure delivery of an adequate quantity of release agent to the fuser roll. A motor 80 and a suitable drive connection are provided for effecting rotation of the roll 61 for transporting the web from the supply roll to the take-up roll.

Any suitable web material capable of withstanding fusing temperatures of the order of 225° C. may be employed. Typically, the web material is capable of being impregnated with at least 25 grams per meter square of liquid release agent. The web material may be woven or nonwoven and of a sufficient thickness to provide a minimum amount of release agent for a desired life. For example, for a web material capable of holding about 30 grams of release agent per square meter, a thickness of 0.07 millimeters will provide a quantity of release agent capable of fusing about 100,000 prints. It should be understood that the principle function of the web is the delivery of the release agent and that a cleaning function wherein the fuser roll is cleaned is secondary. The web is advanced by a clock motor driving the drive shaft of take-up roll 61.

The open celled foam pinch roll may be made of any suitable material which is resistant to high temperatures of the order of the fusing temperature at 22° C. and does not take a permanent set. Typically, it is a molded silicone rubber foam with open cells about 0.5 millimeters in their maximum dimension.

The liquid release agent may be selected from those materials which have been conventionally used. Typical release agents include a variety of conventional used silicone oils including both functional and non-functionally oils. Thus, the release agent is selected to be compatible with the rest of the system. A particularly preferred release agent is an unimodal low molecular weight polysiloxane having a viscosity of about 11,000 centistokes. Such a release agent when used in a release agent delivery system a described above wherein about a 0.07 millimeter thick web is impregnated with at least 25 grams per square meter of release agent and a 20 millimeter diameter open celled, silicone rubber foam roll is also impregnated with the release agent, is consumed at a rate of about 0.3 microliters per copy.

When the supply of impregnated web on the new supply roll (the take-up roll on the first side of the impregnated web) is or is about to be exhausted the supply roll web and take-up roll are removed and replaced with a new supply roll impregnated web and take-up roll which may be used in the same manner wherein initially a first side of the impregnated web is in contact with the fuser roll, its supply exhausted, the web is reversed and the second side of the impregnated web is placed in contact with the fuser roll to deliver release agent to it.

Preferably the web assembly is supplied with a specific length of material already impregnated with the proper amount of oil, rolled on a supply spool with a leader already attached to a take-up roll. This assembly is installed in the machine.

Figure 2:
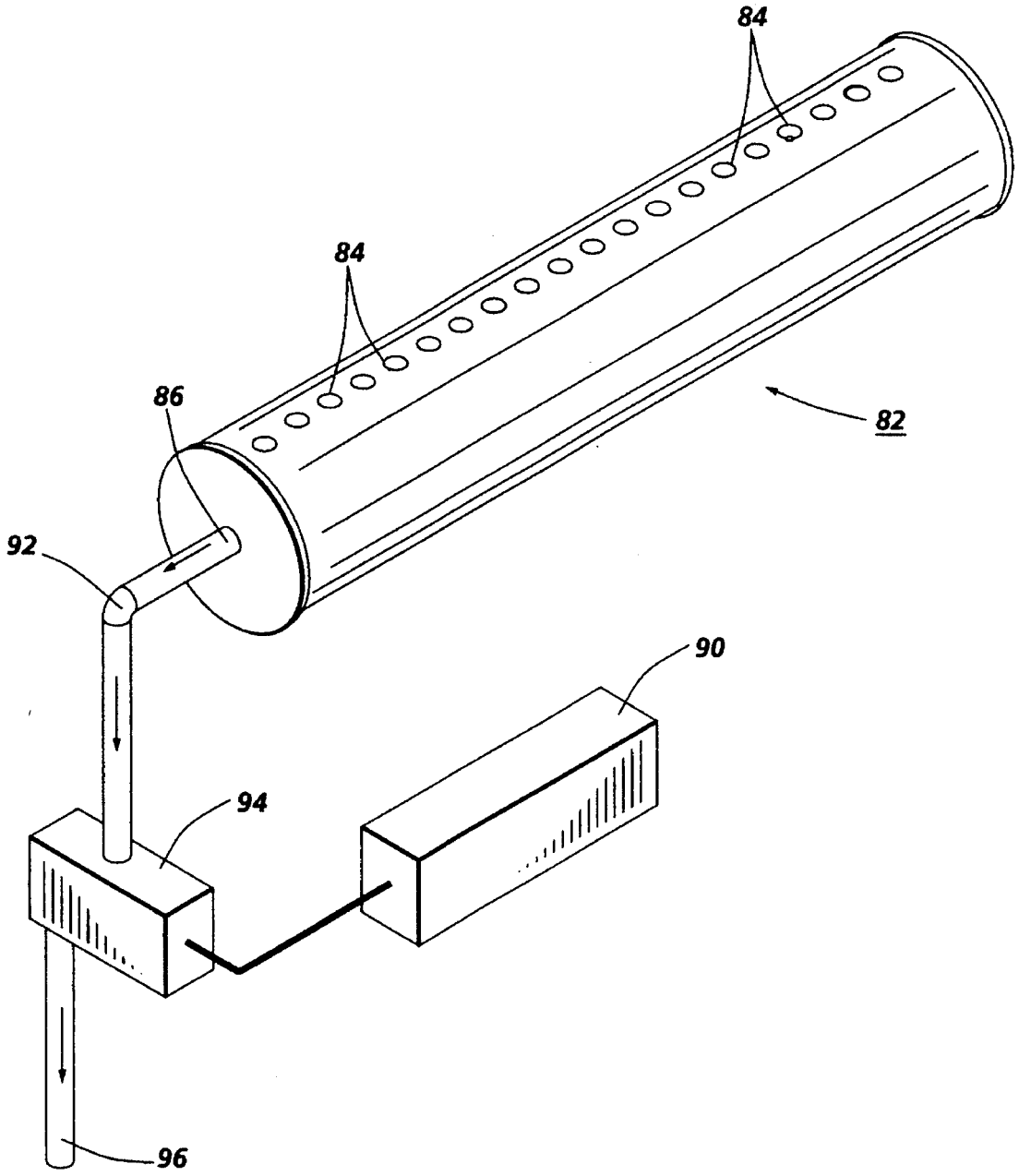
FIG. 2 is an isometric view of an auxiliary oil supply.

An auxiliary release agent supply is provided by an oil application tube 82. The tube, as shown in FIG. 2, is provided with holes 84 in the top thereof. The tube as shown in FIG. 1 is supported in contact with the web 62 for applying oil to the web during high volume imaging or when fixing color images. The holes have a diameter of about 7 mils. An inlet 86 at one end of the tube 82 supplies oil to the tube. A source of oil, not shown, for filling the tube 82 can be a closed system which supplies the oil by gravity or through a pumping action synchronized with fuser roll rotation speed.

The addition of oil to the web, as will be appreciated, results in an adequate amount of oil being available for high volume and color imaging thereby preventing fuser roll degradation due to an insufficient oil supply. The addition of oil will also increase the fuser roll release life for a low volume machine.

A controller 90 (FIGS. 1 and 3) operatively connected to a user interface (not shown) serves to effect application of extra oil to the web via the tube 82. This is effected through the use of an algorithm stored in computer memory. According to the algorithm, when long copy runs or color imaging are indicated, a pump 94 is actuated for conveying oil from a source (not shown) via conduits 92 and 96 to the tube 82.

I claim:

1. Apparatus for applying offset preventing liquid to a fuser roll including:

a supply member;

a rotatable take-up member;

an oil impregnated web member having one end attached to said supply member and its other end attached to said take-up member, said oil impregnated web member containing a predetermined quantity of oil for delivering a predetermined amount of oil to the surface of said fuser member;

a pressure roll in engagement with said oil impregnated web member and positioned to provide a contact nip for said oil impregnated web member with said fuser roll;

and means for applying oil to said oil impregnated web member such that said oil impregnated web member can selectively deliver a quantity of oil in excess of said predetermined amount of oil to the surface of said fuser member.

2. The apparatus of claim 1 wherein said oil applying means comprises a tube having holes in its top and supported in contact with said oil impregnated web member.

3. The apparatus of claim 2 including a controller for selectively effecting delivery of said quantity of oil in excess of said predetermined amount during high volume or color imaging.

4. The apparatus of claim 3 including a pump controlled by said controller for pumping oil into said tube for effecting oil movement through said holes.

5. In a device having a supply core, a rotatable take up core, an oil impregnated web member adapted to be moved from the supply core to the take up core to transfer a predetermined amount of oil from the web member to the fuser roll, a motor for driving the oil impregnated web member from the supply core to the take up core, and a pressure roll in engagement with the oil impregnated web member and positioned to provide a contact nip for the oil impregnated web member with the fuser roll opposite the pressure roll, the method of selectively supplying a quantity of oil in excess of said predetermined amount to said oil impregnated web member for enabling fusing in a high volume imaging apparatus or in color imaging apparatus.

6. The method of claim 5 wherein said step of supplying oil to said oil impregnated web member comprises using a tube having holes therein and which is supported in contact with said oil impregnated web member.

7. The method of claim 6 including the step of using a controller for selectively effecting oil application in a quantity in excess of said predetermined amount during high volume or color imaging.

8. The method of claim 7 including the step of pumping oil into said tube for effecting oil movement through said holes during high volume and color imaging.

* * * * *